US006848694B2

(12) United States Patent
Benoit

(10) Patent No.: US 6,848,694 B2
(45) Date of Patent: Feb. 1, 2005

(54) CHASSIS FOR AN IN-LINE SKATE, AND AN IN-LINE SKATE INCLUDING SUCH CHASSIS

(75) Inventor: Louis Benoit, La Balme de Sillingy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/941,643

(22) Filed: Aug. 30, 2001

(65) Prior Publication Data

US 2002/0014750 A1 Feb. 7, 2002

Related U.S. Application Data

(60) Continuation of application No. 09/377,841, filed on Aug. 20, 1999, now Pat. No. 6,293,563, which is a division of application No. 08/736,995, filed on Oct. 25, 1996, now Pat. No. 6,301,771.

(30) Foreign Application Priority Data

Nov. 14, 1995 (FR) ..... 95 13707

(51) Int. Cl.[7] ..... A63C 17/02
(52) U.S. Cl. ..... 280/11.221; 280/11.222
(58) Field of Search ..... 280/11.221, 11.222, 280/11.27, 11.225, 11.28, 11.17, 11.19, 11.224, 1.231, 11.233, 11.25, 11.26, 11.3, 11.223, 11.231, 11.227

(56) References Cited

U.S. PATENT DOCUMENTS

| | | | | |
|---|---|---|---|---|
| 275,483 A | | 4/1883 | Gregg | 280/11.19 |
| 875,165 A | | 12/1907 | Faust et al. | 280/11.19 |
| 1,294,984 A | | 2/1919 | Ware | 280/11.19 X |
| 1,728,629 A | | 9/1929 | Sahlmann | 280/11.22 X |
| 1,807,890 A | | 6/1931 | Berger | 280/11.27 X |
| 1,977,587 A | | 10/1934 | MacDonnell | 280/11.17 X |
| 2,291,600 A | | 8/1942 | Atkinson | 280/11.23 X |
| 2,531,357 A | | 11/1950 | Foulds | 280/11.27 X |
| 3,877,710 A | * | 4/1975 | Nyitrai | 280/11.223 |
| 4,058,324 A | | 11/1977 | Dallaire | 280/11.22 X |
| 4,273,345 A | | 6/1981 | Ben-Dor et al. | 280/11.2 |
| 5,048,848 A | | 9/1991 | Olson et al. | 280/11.22 |
| 5,326,115 A | * | 7/1994 | Seltzer | 380/11.19 |
| 5,388,846 A | | 2/1995 | Gierveld | 280/11.22 |
| 5,456,477 A | * | 10/1995 | Bourdeau | 280/11.221 |
| 5,560,625 A | | 10/1996 | Kuykendall | 280/11.22 |
| 5,735,536 A | | 4/1998 | Myers et al. | 280/11.19 |
| 5,810,369 A | | 9/1998 | Wilder et al. | 280/11.22 |
| 5,848,796 A | | 12/1998 | Meibock et al. | 280/11.22 |
| 5,913,526 A | | 6/1999 | Olson et al. | 280/11.22 |
| 5,964,537 A | * | 10/1999 | Hill, Jr. | 280/11.221 |
| 6,053,512 A | | 4/2000 | Chang | 280/11.22 |
| 6,293,563 B1 | * | 9/2001 | Benoit | 280/11.221 |

FOREIGN PATENT DOCUMENTS

| | | |
|---|---|---|
| CH | 105264 | 6/1924 |
| DE | 1033569 | 7/1958 |
| EP | 0043250 | 1/1982 |
| FR | 495821 | 10/1919 |
| FR | 943511 | 3/1949 |

* cited by examiner

*Primary Examiner*—Hau Phan
(74) *Attorney, Agent, or Firm*—Greenblum & Bernstein, P.L.C.

(57) ABSTRACT

A chassis for a gliding sport element, such as a skate, and, more particularly, such as an in-line roller skate, which includes such chassis. The chassis includes at least one support surface capable of receiving a boot and at least one lateral flange having at least one stiffening rib formed on at least one of the flanges. The gliding member(s), such as wheels, are mounted to the lateral flange(s).

41 Claims, 3 Drawing Sheets

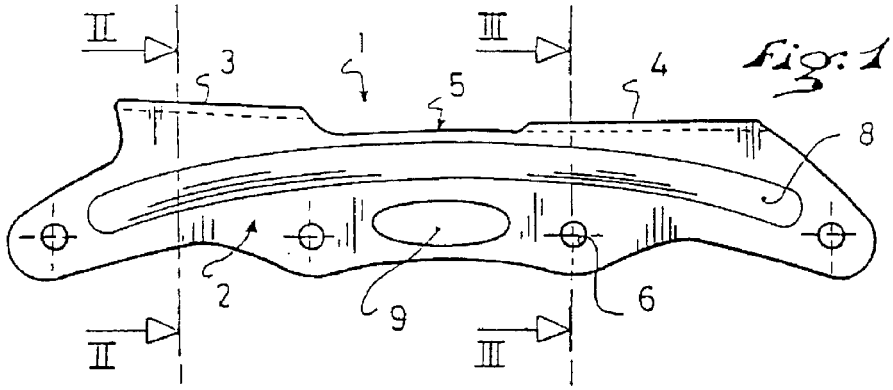
Fig: 1
Fig: 2
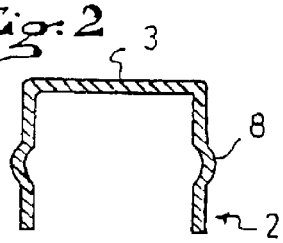
Fig: 2a
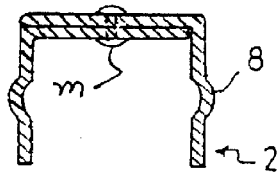
Fig: 3
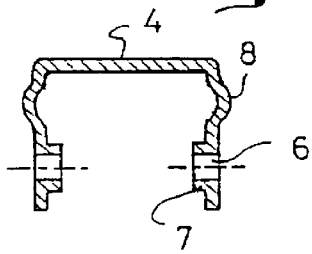
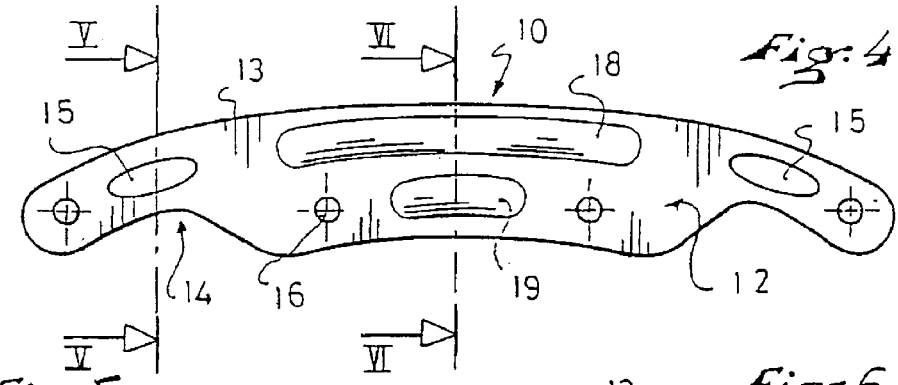
Fig: 4
Fig: 5
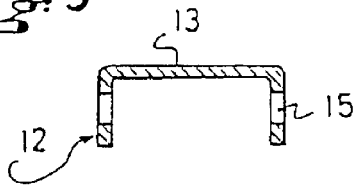
Fig: 6
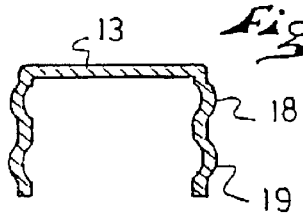

CHASSIS FOR AN IN-LINE SKATE, AND AN IN-LINE SKATE INCLUDING SUCH CHASSIS

CROSS-REFERENCE TO RELATED APPLICATIONS

This application is a continuation of application Ser. No. 09/377,841, filed on Aug. 20, 1999, now U.S. Pat. No. 6,293,563, issued on Sep. 25, 2001, which is a division of application Ser. No. 08/736,995, filed on Oct. 25, 1996, now U.S. Pat. No. 6,301,771, issued on Oct. 16, 2001, the disclosures of which are hereby incorporated by reference thereto in its entirety and the priority of which is claimed under 35 USC 120.

This application is also based upon French application No. 95.13707, filed on Nov. 14, 1995, the disclosure of which is hereby incorporated by reference thereto in its entirety and priority of which is hereby claimed under 35 USC 119.

BACKGROUND OF THE INVENTION

1. Field of the Invention

The present invention relates to chassis, or frame, for a gliding sport element such as an in-line roller skate or an ice skate, and a gliding sport element, such as an in-line or ice skate, including such a chassis.

2. Description of Background and Relevant Information

A chassis of the aforementioned type must ensure the linkage between the gliding member(s) themselves, namely the skate blade, wheels, or rollers, and the user's foot.

The chassis is therefore generally constituted by a support surface that is capable of receiving the boot of the athlete, and by one or two lateral flanges adapted to receive the wheels, rollers, or the blade of the skate.

The chassis must also have substantial characteristics of mechanical resistance while being as light as possible, to avoid the forces imposed by the athlete from being too substantial.

Furthermore, the increasing technicality of these gliding sport elements, especially for in-line roller skates, further increases the conflicting requirements which must be met by the skate chassis, namely:

- an increased mechanical resistance, or strength, and stability, especially for speed skates, but also for the so-called free ride, free style, or hockey skates;
- some flexibility, especially in certain zones of the skate to enable the shape of the skate to adapt to the path covered, especially in turns at high speed;
- various and original forms the meet emerging and changing fashion requirements; and
- a lowest possible manufacturing cost.

The techniques used in manufacturing the currently known chassis do not make it possible to meet all of these requirements, while maintaining a reasonable manufacturing cost.

Indeed, the oldest manufacturing technique consists of making such chassis from a U-shaped folded or bent metal sheet, as disclosed in the patent document DE 10 33 569, for example.

Such a manufacturing principle, while inexpensive, does not, however, make it possible to obtain a large variety of forms, nor a chassis with substantial mechanical strength, unless the thickness of the metal sheet, and therefore the weight thereof, are substantially increased.

Another commonly used technique consists of making the chassis by molding from a synthetic, or metallic, material. Molding offers the advantage of allowing various forms, but it also has numerous disadvantages:

- the cost of the molds;
- limited selection of materials capable of being molded;
- low mechanical resistance of these molding materials, even when they are metallic; and
- insufficient molding precision, requiring additional machining, especially with respect to alignment of the holes for fixing the wheels or the skate blade on a two-flange chassis.

Chassis made of composite fibers are also known. These chassis can indeed be made in almost all possible forms, but their manufacture is extremely expensive and difficult to industrialize. Furthermore, while such chassis are extremely rigid, they lack flexibility and are therefore fragile and "uncomfortable."

Finally, U.S. Pat. No. 5,388,846 has proposed to make a chassis for ice skates or roller skates from a profiled metallic bar whose transverse cross section corresponds to the general section desired for the chassis, the final form of the chassis being obtained after machining with removal of material.

Such a manufacturing method is also very expensive, due to the necessary machining period and the quantity of material to be removed. It does not allow for a great freedom with respect to the form or profile of the chassis.

SUMMARY OF THE INVENTION

An object of the present invention is to remedy the aforementioned drawbacks and to provide an improved chassis for a gliding sport element, as well as a gliding sport element, such as an in-line skate, employing such improved chassis, which resolves the various aforementioned problems and, in particular, to reconcile the characteristics of mechanical strength or resistance, adaptability, flexibility, lightness, and a low manufacturing cost.

The chassis of the gliding element according to the invention is made by cutting from a metallic flank or sheet a form corresponding substantially the developed, or completed, form of at least one portion of the chassis, and providing at least one stiffening rib by pressing such portion of the chassis.

Indeed, stiffening the chassis by means of one or more stiffening ribs by pressing enables, at equal weight with respect to a chassis merely obtained by bending, a substantial increase in the characteristics of rigidity and resistance to deformation due, on the one hand, to the presence of such ribs, but also to the localized work hardening of the material obtained in the area of such ribs related to the manufacturing method by pressing.

Depending on the desired results, one can provide each rib to extend substantially along the entire length of the flange of the chassis, or only over a limited central zone of each flange, or yet in the area of the ends of each flange.

BRIEF DESCRIPTION OF THE DRAWINGS

The invention will be better understood and other characteristics will become apparent along the description that follows, with reference to the annexed schematic drawing showing, by way of non-limiting examples, a plurality of embodiments of the chassis, and in which:

FIG. 1 is a side view of a chassis according to a first embodiment;

FIG. 2 is a cross-sectional view along the line II—II of FIG. 1;

FIG. 2*a* is a view, similar to FIG. 2, of an alternative embodiment;

FIG. 3 is a cross-sectional view along the line III—III of FIG. 1;

FIG. 4 is a side view of a chassis according to a second embodiment;

FIG. 5 is a cross-sectional view along the line V—V of FIG. 4;

FIG. 6 is a cross-sectional view along the line VI—VI of FIG. 4;

DETAILED DESCRIPTION OF THE INVENTION

Figure 7:
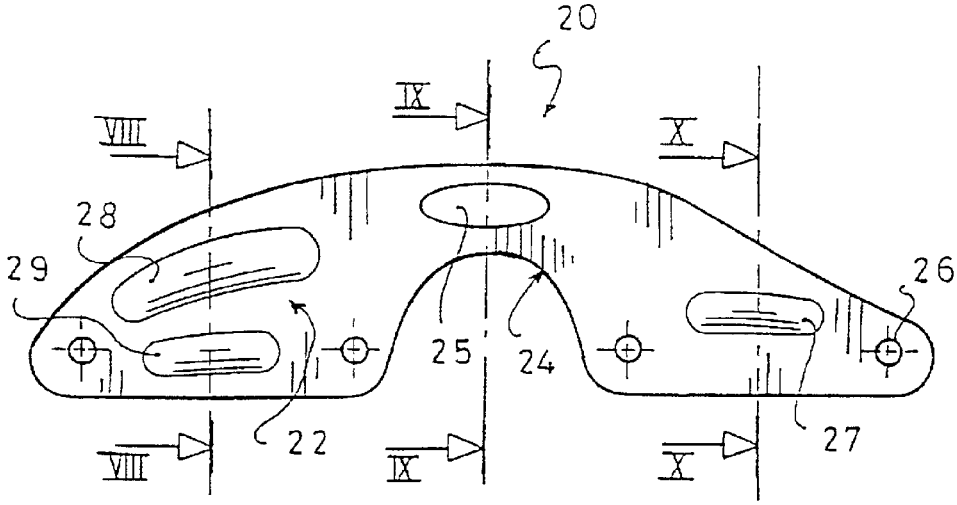
FIG. 7 is a side view of a chassis according to a third embodiment.
Figure 8:
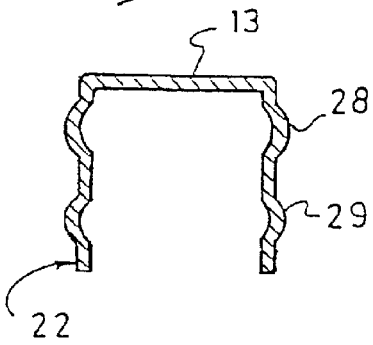
FIG. 8 is a cross-sectional view along the line VII—VII of FIG. 7.
Figure 9:
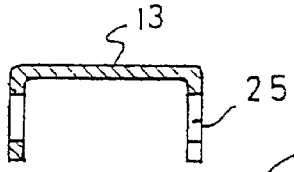
FIG. 9 is a cross-sectional view along the line IX—IX of FIG. 7.
Figure 10:
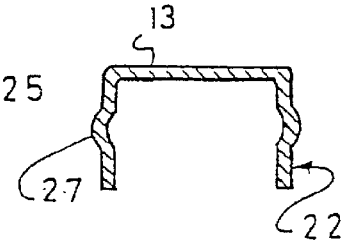
FIG. 10 is a cross-sectional view along the line X—X of FIG. 7.

As shown in FIGS. 1–3, the chassis according to the invention is made from a metal sheet, and has the general form of two lateral flanges 2, i.e., a medial flange and a lateral flange, connected to each other by two platforms 3, 4, providing the assembly with a substantially U-shaped transverse section.

Each of the platforms 3, 4, or foot-bearing portions of the chassis, constitutes a support surface capable of receiving the boot of the athlete, the latter (not shown in the drawing) being fixed by any known means, especially glue, rivets, screws, etc., but it can also be fixed removably by non-permanent connection means.

One will also note that the platforms 3, 4 are distinct and separated from one another by a cut-out 5, and they are located at different levels in height, the front platform 4 being lower than the rear platform 3, to take into account the natural position of the athlete, in which the heel is slightly raised.

Each flange 2 has an elongated form that is bent in an arc of a circle in the longitudinal direction.

Holes 6 for the attachment of the rollers or the skate blade, as the case may be, are provided at the lower end of each flange.

Each hole 6 is made in a cylindrical boss 7 that can be made by die forging. The holes 6 located correspondingly in the two flanges are coaxial.

Each flange 2 further has a pressed rib 8 that extends substantially along the entire length of the flange 2, above the attachment holes 6, and has a generally arched shape.

Each of the transversely spaced apart medial and lateral flanges 2 includes a bottom portion, generally at which the wheels or gliding blade is to be attached, and a top portion adjacent to the foot-bearing portions. The top and bottom portions of each of the flanges are substantially coplanar and, in a particular embodiment, the top portions of the medial and lateral flanges are spaced apart by a distance equal to that by which the bottom portions of the medial and lateral flanges are spaced apart. Further, it can be considered that each of the medial and lateral flanges includes an intermediate portion between the top and bottom portions, preferably made by pressing. In a particular embodiment, the intermediate portions can be substantially non-coplanar with the bottom portions of the respective flanges.

As shown particularly in FIGS. 2 and 3, each rib 8 has a substantially constant thickness corresponding to that of the metal sheet constituting the flanges 2 and each of the platforms 3, 4, and it has a recessed form which is curved outwardly, this recessed form and the constant thickness being characteristic of a form obtained by pressing.

Furthermore, the rib 8 has a longitudinal extent that varies in vertical position and extends other than along a single straight line along the entirety of its length. In the particular illustrated embodiment, each rib 8 preferably follows the contour of the flanges 1, 2, on which it is pressed and therefore has, in this case, an elongated form which is also slightly curved continuously in the longitudinal direction, a center portion being relatively raised, i.e., at a higher elevation, with respect to a straight line connecting opposite end portions.

As shown in the embodiment of FIG. 1, and similarly for other illustrated exemplary embodiments, the stiffening rib 8 extends along substantially the entirety, but less than along the entirety of the flanges 2, thereby leaving longitudinally extending opposite end portions of the flanges substantially flat, end holes 6 being shown in these opposite end areas. Further, the stiffening rib, as shown, is continuous between opposite ends, i.e., the rib is not interrupted by a cut-out or other opening.

Such a pressed rib 8 provide the flange, on which it is obtained, a substantial increase in the moment of inertia and of the resistance to deformation both in the longitudinal and vertical directions, this increase being related not only to the presence of each rib 8 and to the shape thereof, but also to the work hardening of the material in the rib area during the pressing operation.

Such a construction and manufacturing concept practically make it possible to divide in two the thickness and therefore, the weight, of the metal sheet used to make the chassis with respect to a bent, molded, or profiled chassis, while maintaining, or even increasing, the mechanical characteristics.

This method results in an extremely light, resistant, and inexpensive chassis.

Advantageously, the chassis will be made from laminated metal sheet whose fibers are oriented along the longitudinal direction of the chassis. Such a characteristic also makes it possible to increase the resistance qualities of the chassis in the longitudinal direction, especially with respect to a chassis made of an injected or cast alloy in which there is no formation of fibers.

Furthermore, it is possible to modify the moment of inertia of the chassis by providing appropriate cut-outs such as 5, 9. As shown, these cut-outs are perimetric, i.e., they are through holes that are completely contained within the outer boundaries of the chassis.

In the present case, the cut-out 9, which is oval and arranged centrally beneath the rib 8, makes it possible to reduce the flexional stiffness of each flange 2 in the central zone of the chassis and, in combination with the cut-out 5 which also arranged centrally, also makes it possible to reduce the flexional stiffness of the entire chassis in this zone. In the embodiment of FIG. 1, the cut-out 9 extends longitudinally between the two intermediate holes 6, the rib 8 extending above the cut-out and beyond the intermediate holes 6.

Such a chassis can be obtained very simply and in a single piece from a metal sheet in a succession of steps, such as the following:

first, the sheet of metal is precut in a form corresponding to the completed form of the chassis with an increased surface in the zone of each rib to take into account the shrinking of material during the pressing;

all cut-outs such as 5 and 9 are also made during this first die cutting operation;

the two ribs 8 of the two flanges 1, 2 are then made by pressing;

the holes 6 are then made by extrusion and are possibly threaded, after a preliminary die forging of the bosses 7;

the metal sheet is finally bent or folded into a U-shape.

Of course, the series of operations described above only applies if the chassis is made in a single piece from the same metallic sheet.

The chassis can also be made in a plurality of portions assembled by any known means, such as screws, rivets, welds, etc.

More particularly, as shown in FIG. 2*a*, each chassis can be constituted by two flanges having a generally "L"-shaped transverse section and being connected to one another by the small arm of each "U" by known means m such as rivets.

With respect to an aluminum chassis made of an alloy obtained by injection during molding, such a manufacturing technique by pressing, and possibly by die forging, bending, is much more precise, does not require any subsequent machining, and makes it possible to have a greater selection of material, with more interesting characteristics. Indeed, the number of available materials for injection or molding is very limited, and these materials are generally brittle and do not promote the formation of fibers.

Moreover, since the molding and injection techniques are not sufficiently precise, time-consuming, and expensive additional machining would be necessary to obtain the holes for attaching the gliding member(s), for example.

One will also note that the geometrical properties of a pressed chassis are clearly greater than those of a chassis made out of plastic materials, in which, due to the shrinking of the material, one is confronted with the phenomena of twisting and alignment of the wheels' attachment holes, thereby requiring additional machining.

By way of example, the necessary periods to produce a chassis using the various techniques can be assessed as follows:

plastic materials . . . 15 seconds profiled and machined aluminum . . . 180 seconds cast aluminum . . . 85 seconds pressed aluminum . . . 6 seconds Therefore, one notes the triple gain, in terms of the manufacturing time and cost, characteristics of the material and lightness, that is made by using the technique according to the invention.

Another extremely advantageous characteristic of the pressing technique resides in the fact that the possibilities in terms of design are greater than those of the aluminum profile that does not allow any embossing or form on the sheets of the profile which are necessarily planar.

Furthermore, the method and construction according to the invention offer greater possibilities in varying the moment of inertia of the chassis along the longitudinal axis thereof, by providing adapted ribs, cut-outs, or heights of the sheets, in order to obtain a deformation of the chassis and an optimum behavior of the chassis as a function of the desired practice.

Thus, the chassis described with reference to FIGS. 1–3 offers a quasi uniform rigidity along its entire length, whereas the other two examples of chassis shown in FIGS. 4–6 and 7–10 make it possible to obtain different characteristics.

The chassis 10 shown in FIGS. 4–6 includes, as is the case for the chassis 1, two lateral flanges 12, but a single platform 13 extending along its entire length.

The chassis 10 further has a form that is clearly curved in a arc of a circle.

Each flange 12 has at each end a cut-out 15 as well as a perimetric narrowing 14 providing it with flexibility and a low moment of inertia in these zones.

Conversely, each flange 12 is provided in its median zone with two superimposed pressed ribs 18, 19. Inasmuch as rib 19 has a relatively short length, i.e., relative to the rib 18, e.g., it might be better regarded as a boss, or an elongated or non-circular boss.

Such a chassis therefore has a very substantial rigidity in the center, in the zone of ribs 18, 19, and relatively flexible ends.

The chassis 20 shown in FIGS. 7–10 includes, as is the case for the chassis 10, two lateral flanges 22 and a single platform 13 extending along its entire length. It also has the shape of an arc of a circle. Each flange 22 has:

two superimposed ribs 28, 29 at its rear end, at least the rib 28 extending forwardly in a continuous curved shape;

a cut-out 25 and a perimetric narrowing 24 in its central zone; and a single rib 27 at its front end.

Such a chassis will therefore be very rigid at the rear, very flexible in the center, and moderately rigid at the front.

Each of the ribs 8, 18, and 28 of the examples of the invention described above extends longitudinally at a variable height relative to a line that connects the opposite ends of the ribs. Further, each of the ribs 8, 18, and 28 is downwardly curved.

Figure 11:
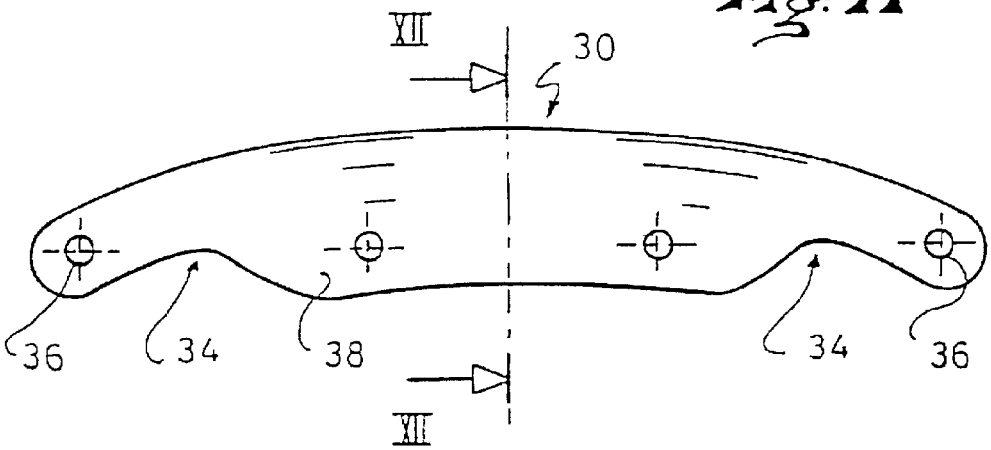
FIG. 11 is a side view of a chassis according to a fourth embodiment.
Figure 12:
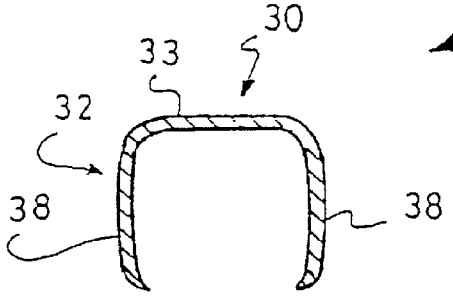
FIG. 12 is a cross-sectional view along the line XII—XII of FIG. 11.
Figure 13:
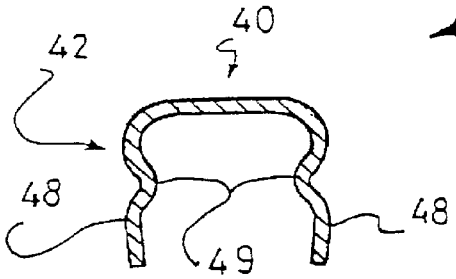
FIG. 13 is a view similar to FIG. 12 showing yet another embodiment.

FIGS. 11–13 show other embodiments of a chassis.

In the case of FIGS. 11 and 12, each lateral flange 32 of the chassis 30 is pressed over its entire surface and, therefore, constitutes a large and single rib 38 which is slightly bent outwardly.

Therefore, such a chassis has particularly homogeneous characteristics of torsional and flexional rigidity along its entire length, the only more flexible zones being defined at the front and rear by scallops 34.

Finally, FIG. 13 shows yet another example of cross pressing of the lateral flanges 42 of a chassis 40, in which each flange is pressed outwardly a first time, then inwardly a second time, thus defining two external "ribs" 48 and an internal median rib 49.

A simple pressing of each internal rib 49 is also possible.

The present invention is not limited to the particulars of the examples described hereinabove. It can apply to any chassis for any sport element that must meet the same requirements.

What is claimed is:

1. A chassis for an in-line skate, said chassis comprising:

at least one substantially horizontal foot-bearing portion;

one longitudinally extending lateral flange extending downwardly from said foot-bearing portion, and one longitudinally extending medial flange extending downwardly from said foot-bearing portion;

each of said lateral flange and said medial flange having a top portion and a bottom portion, wherein:

both said top portions of said lateral flange and said medial flange being transversely spaced apart and both said bottom portions of said lateral flange and said medial flange being adapted to have attached therebetween at least one wheel;

each of said lateral flange and said medial flange further having a stiffening rib, said stiffening rib comprising a stamped metal, extending longitudinally other than in a straight line.

2. A chassis according to claim 1, wherein at least one of said lateral and medial flanges includes a cut-out.

3. A chassis according to claim 1, wherein said stiffening rib of at least one of said lateral and medial flanges projects inwardly.

4. A chassis according to claim 1, wherein said stiffening rib of at least one of said lateral and medial flanges projects outwardly.

5. A chassis according to claim 1, wherein said top portion of each of said lateral and medial flanges is adjacent to said foot-bearing portion.

6. A chassis according to claim 1, wherein said stiffening rib of said lateral flange has an end extending downwardly toward an end of said lateral flange, and said stiffening rib of said medial flange has an end extending downwardly toward an end of said medial flange.

7. A chassis according to claim 1, wherein:

both of said lateral and medial flanges include a front end portion and a rear end portion;

said front end portion includes top and bottom edges, both of said top and bottom edges of said front end portion extending both forwardly and downwardly; and said rear end portion includes top and bottom edges, both of said top and bottom edges of said rear end portion extending both rearwardly and downwardly.

8. A chassis according to claim 1, wherein:

both of said lateral and medial flanges comprise means for attaching said at least one wheel to said lateral and medial flanges, said means being arranged longitudinally along said lateral and medial flanges; and said stiffening rib of each of said lateral and medial flanges are positioned above said means for attaching.

9. A chassis according to claim 1, wherein said lateral flange, said medial flange, and said foot-bearing portions, in transverse cross section, comprise a substantially U-shape.

10. A chassis according to claim 1, wherein said at least one foot-bearing portion, said lateral flange, and said medial flange are formed as a single piece.

11. A chassis according to claim 1, wherein said at least one foot-bearing portion comprises two longitudinally spaced-apart foot-bearing portions, and wherein said two longitudinally spaced-apart foot-bearing portions, said lateral flange, and said medial flange are formed as a single piece.

12. A chassis for an in-line skate, said chassis comprising:

at least one substantially horizontal foot-bearing portion;

one longitudinally extending lateral flange extending downwardly from said foot-bearing portion, and one longitudinally extending medial flange extending downwardly from said foot-bearing portion;

each of said lateral flange and said medial flange having a top portion and a bottom portion, wherein:

both said top portions of said lateral flange and said medial flange being transversely spaced apart and both said bottom portions of said lateral flange and said medial flange being adapted to have attached therebetween at least one wheel;

each of said lateral flange and said medial flange having a stiffening rib, said stiffening rib comprising a stamped metal, extending longitudinally other than in a straight line;

each of said stiffening rib of said lateral flange and said stiffening rib of said medial flange comprises opposite ends, each of said stiffening ribs being continuous between said opposite ends.

13. A chassis for an in-line skate, said chassis comprising:

at least one substantially horizontal foot-bearing portion;

one longitudinally extending lateral flange extending downwardly from said foot-bearing portion, and one longitudinally extending medial flange extending downwardly from said foot-bearing portion;

each of said lateral flange and said medial flange having a top portion and a bottom portion, wherein:

both said top portions of said lateral flange and said medial flange being transversely spaced apart and both said bottom portions of said lateral flange and said medial flange being adapted to have attached therebetween at least one wheel;

each of said lateral flange and said medial flange having a non-circular boss, said boss comprising a stamped metal, said boss extending longitudinally other than in a straight line.

14. A chassis according to claim 13, wherein said top portion of each of said lateral and medial flanges is adjacent to said foot-bearing portion.

15. A chassis according to claim 13, wherein each of said lateral and medial flanges have a plurality of holes for receiving axles of wheels adapted to be positioned between said lateral and medial flanges, and wherein said bosses do not surround said holes.

16. A chassis according to claim 15, further comprising a plurality of in-line wheels mounted between said lateral and medial flanges.

17. A chassis according to claim 13, wherein each of said lateral and medial flanges have a plurality of holes for receiving axles of wheels adapted to be positioned between said lateral and medial flanges, and wherein said bosses are spaced from said holes.

18. A chassis according to claim 17, further comprising a plurality of in-line wheels mounted between said lateral and medial flanges.

19. An in-line skate comprising:

at least one substantially horizontal foot-bearing portion;

one longitudinally extending lateral flange extending downwardly from said foot-bearing portion, said lateral flange comprising a metal;

one longitudinally extending medial flange extending downwardly from said foot-bearing portion, said medial flange comprising a metal;

each of said lateral flange and said medial flange having a top portion, and a bottom portion substantially coplanar with said top portion, wherein:

both said top portions of said lateral flange and said medial flange being equally transversely spaced apart and being adapted to have attached therebetween at least one wheel;

said metal of each of said lateral flange and said medial flange comprising a stamped aluminum intermediate portion, substantially non-coplanar with said bottom portions of said lateral flange and said medial flange, and extending longitudinally other than in a single straight line.

20. An in-line skate according to claim 19, wherein each of said lateral and medial flanges extends continuously between said top portion and said bottom portion via said intermediate portion.

21. An in-line skate according to claim 19, wherein said top portion of each of said lateral and medial flanges is adjacent to said foot-bearing portion.

22. An in-line skate according to claim 19, wherein said lateral and medial flanges comprise distinct parts of a multiple-part chassis of the in-line skate, said distinct parts having been assembled together.

23. An in-line skate according to claim 22, wherein said lateral and medial flanges are assembled together by means of screws or rivets or welds.

24. An in-line skate according to claim 23, wherein each of said lateral and medial flanges has a transverse generally L-shape including a small arm, and wherein said screws or rivets or welds assemble together said small arm of each of said lateral and medial flanges.

25. An in-line skate comprising:

at least one longitudinally extending foot-bearing portion;

one longitudinally extending lateral flange extending downwardly from said foot-bearing portion and having a lateral top portion, and a lateral bottom portion adapted to have attached thereto at least one wheel;

one longitudinally extending medial flange extending downwardly from said foot-bearing portion and having a medial top portion, and a medial bottom portion adapted to have attached thereto at least one wheel;

said lateral top portion being spaced apart by a first distance from said medial top portion;

said lateral bottom portion being spaced apart by said first distance from said medial bottom portion;

said lateral flange further having a lateral intermediate portion comprising a stamped metal, said lateral intermediate portion being substantially non-coplanar with said lateral bottom portion and extending longitudinally other than in a single straight line;

said medial flange further having a medial intermediate portion having been made by pressing, said medial intermediate portion being substantially non-coplanar with said medial bottom portion and extending longitudinally other than in a single straight line;

said lateral intermediate portion being spaced apart by a second distance from said medial intermediate portion, said second distance being different from said first distance.

26. An in-line skate according to claim 25, wherein said lateral flange extends continuously from said lateral top portion to said lateral bottom portion via said lateral intermediate portion, and said medial flange extends continuously between said medial top portion and said medial bottom portion via said medial intermediate portion.

27. An in-line skate according to claim 25, wherein said lateral intermediate portion has a longitudinally curved contour.

28. An in-line skate according to claim 25, wherein said top portion of each of said lateral and medial flanges is adjacent to said foot-bearing portion.

29. An in-line skate according to claim 25, wherein said lateral and medial flanges comprise distinct parts of a multiple-part chassis of the in-line skate, said distinct parts having been assembled together.

30. An in-line skate according to claim 29, wherein said lateral and medial flanges are assembled together by means of screws or rivets or welds.

31. An in-line skate according to claim 30, wherein each of said lateral and medial flanges has a transverse generally L-shape including a small arm, and wherein said screws or rivets or welds assemble together said small arm of each of said lateral and medial flanges.

32. An in-line skate according to claim 25, wherein each of said lateral and medial intermediate portions has at least an outwardly raised segment extending lengthwise and having a variance in height lengthwise.

33. An in-line skate comprising:

at least one longitudinally extending foot-bearing portion;

one longitudinally extending lateral flange extending downwardly from said foot-bearing portion and having a lateral top portion, a lateral bottom portion adapted to have attached thereto at least one wheel and a lateral intermediate portion;

one longitudinally extending medial flange extending downwardly from said foot-bearing portion and having a medial top portion, a medial bottom portion adapted to have attached thereto at least one wheel and a medial intermediate portion;

said lateral top portion being spaced apart by a first distance from said medial top portion;

said lateral bottom portion being spaced apart by said first distance from said medial bottom portion;

at least one of said lateral intermediate portion and said medial intermediate portion comprising a stamped metal and being substantially non-coplanar with said lateral bottom portion;

said lateral intermediate portion being spaced apart by a second distance from said medial intermediate portion, said second distance being different from said first distance;

each of said lateral and medial intermediate portions extending longitudinally other than in a single straight line.

34. An in-line skate according to claim 33, wherein said top portion of each of said lateral and medial flanges is adjacent to said foot-bearing portion.

35. An in-line skate according to claim 33, wherein said lateral and medial flanges comprise distinct parts of a multiple-part chassis of the in-line skate, said distinct parts having been assembled together.

36. An in-line skate according to claim 35, wherein said lateral and medial flanges are assembled together by means of screws or rivets or welds.

37. An in-line skate according to claim 36, wherein each of said lateral and medial flanges has a transverse generally L-shape including a small arm, and wherein said screws or rivets or welds assemble together said small arm of each of said lateral and medial flanges.

38. A chassis for an in-line skate, said chassis comprising:

at least one substantially horizontal foot-bearing portion;

one longitudinally extending lateral flange extending downwardly from said foot-bearing portion, and one longitudinally extending medial flange extending downwardly from said foot-bearing portion;

each of said lateral flange and said medial flange having a top portion and a bottom portion, wherein:

both said top portions of said lateral flange and said medial flange being transversely spaced apart and both said bottom portions of said lateral flange and said medial flange being adapted to have attached therebetween at least one wheel;

each of said lateral flange and said medial flange further having a stiffening rib, said stiffening rib comprising a stamped metal, extending longitudinally other than in a straight line;

said stiffening rib of said lateral flange and said stiffening rib of said medial flange have longitudinally extending curved shapes, said curved shapes having a downwardly facing concavity.

39. A chassis for an in-line skate, said chassis comprising:

at least one substantially horizontal foot-bearing portion;

one longitudinally extending lateral flange extending downwardly from said foot-bearing portion, and one longitudinally extending medial flange extending downwardly from said foot-bearing portion;

each of said lateral flange and said medial flange having a top portion and a bottom portion, wherein:

both said top portions of said lateral flange and said medial flange being transversely spaced apart and both said bottom portions of said lateral flange and said medial flange being adapted to have attached therebetween at least one wheel;

each of said lateral flange and said medial flange further having a stiffening rib, said stiffening rib comprising a stamped metal, extending longitudinally other than in a straight line;

both said stiffening rib of said lateral flange and said stiffening rib of said medial flange have a longitudinal portion intermediate of opposite ends, said intermediate portion having a higher elevation relative to said opposite ends.

40. A chassis for an in-line skate, said chassis comprising:

at least one substantially horizontal foot-bearing portion;

one longitudinally extending lateral flange extending downwardly from said foot-bearing portion, and one longitudinally extending medial flange extending downwardly from said foot-bearing portion;

each of said lateral flange and said medial flange having a top portion and a bottom portion, wherein:

both said top portions of said lateral flange and said medial flange being transversely spaced apart and both said bottom portions of said lateral flange and said medial flange being adapted to have attached therebetween at least one wheel;

each of said lateral flange and said medial flange further having a stiffening rib, said stiffening rib comprising a stamped metal, extending longitudinally other than in a single straight line.

41. A chassis for an in-line skate according to claim 40, wherein said lateral and medial flanges comprise distinct parts of a multiple-part chassis, said distinct parts having been assembled together.

* * * * *